United States Patent [19]

Ford et al.

[11] Patent Number: 4,531,782

[45] Date of Patent: Jul. 30, 1985

[54] MINING EQUIPMENT

[75] Inventors: John A. Ford; Raymond A. Whittaker, both of Burton-on-Trent, England

[73] Assignee: Coal Industry (Patents) Ltd., London, England

[21] Appl. No.: 494,529

[22] Filed: May 13, 1983

[30] Foreign Application Priority Data

Jun. 11, 1982 [GB] United Kingdom ..... 8217090

[51] Int. Cl.[3] ..... E21C 27/20

[52] U.S. Cl. ..... 299/1; 91/189 R

[58] Field of Search ..... 299/1; 175/45; 91/517, 91/37, 189

[56] References Cited

U.S. PATENT DOCUMENTS

| | | | |
|---|---|---|---|
| 2,965,077 | 12/1960 | Van Den Bussche | 91/189 |
| 3,030,930 | 4/1962 | Gratzmuller | 91/189 |
| 3,436,922 | 4/1969 | Irresberger | 91/189 |
| 4,371,209 | 2/1983 | Alford et al. | 299/1 |

FOREIGN PATENT DOCUMENTS

| | | | |
|---|---|---|---|
| 1132765 | 11/1968 | United Kingdom | 299/1 |
| 1207200 | 9/1970 | United Kingdom | 299/1 |
| 2068436A | 8/1981 | United Kingdom | 299/1 |

*Primary Examiner*—Stephen J. Novosad
*Assistant Examiner*—M. Goodwin
*Attorney, Agent, or Firm*—Stevens, Davis, Miller & Mosher

[57] ABSTRACT

Mining equipment for steering the cutting horizon of a mining machine cutter which is mounted on a ranging arm and which in use makes repeated traverses along the working face, comprises a boom urged into contact with the mine roof formed on a previous traverse of the machine. The boom is urged towards the mine roof by a ram hydraulically connected to a piston and cylinder device such that movement of the piston of the device is in accordance with that of the ram. Movement of the piston rod activates a flow control valve controlling operation of a ram controlling ranging of the arm.

9 Claims, 6 Drawing Figures

MINING EQUIPMENT

This invention relates to mining equipment for use in steering the cutting horizons of mining machines.

In particular, although not exclusively, the present invention relates to mining equipment for use in steering a rotary cutter head mounted on a ranging arm provided on a longwall mining machine, the equipment being adapted to sense a cutting horizon made on a previous traverse of the machine along the face and to steer the current cutting horizon in accordance with the sensed previous cutting horizon.

An object of the present invention is to provide such mining equipment which is simple, robust and reliable and suited to the arduous conditions encountered on a longwall face in an underground mine.

According to the present invention mining equipment for steering the cutting horizon of a mining machine cutter which is mounted on a ranging arm and which in use, makes repeated cutting traverses, comprises a boom movably mountable with respect to the ranging arm, hydraulic motor means for urging the boom towards a rock or mineral boundary to sense a cutting horizon made by the cutter on a previous traverse, hydraulic sensor means arranged to sense operation of the hydraulic motor means and to control means for controlling the current cutting horizon made by the cutter in accordance with the sensed operation of the hydraulic motor means.

Preferably, the hydraulic motor and sensor means comprise piston and cylinder devices.

Preferably, the piston and cylinder devices are hydraulically connected in series such that fluid drawn into or discharged from the hydraulic motor means activates the sensor means.

Conveniently, the piston and cylinder device constituting the hydraulic sensor means comprises an element movable in accordance with the operational condition of the piston and cylinder device and thereby tending to control said means for controlling the current cutting horizon made by the cutter in accordance with the sensed operation of the piston and cylinder device constituting the hydraulic motor means.

Preferably, the element is arranged for longitudinal movement and said means for controlling the current cutting horizon comprises a flow control valve having a plunger arranged to follow a working profile provided by the element.

Conveniently, the element is movable with the movable component of the piston and cylinder device constituting the sensor means.

Preferably, the piston constitutes the movable component and the element extends substantially parallel to the piston rod.

Preferably, the flow control valve is mounted on a base plate supporting the piston and cylinder device constituting the sensor means.

Preferably, the flow control valve is mounted on the base plate by means permitting the position of the valve on the base plate to be pre-set.

Figure 5:
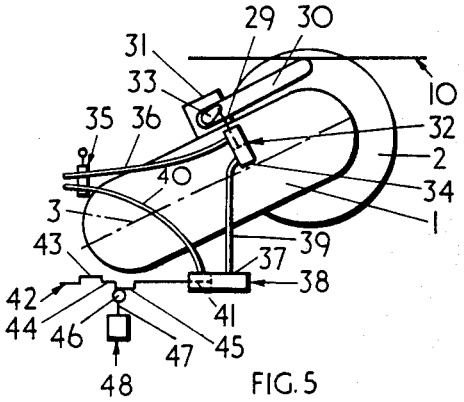
Figure 6:
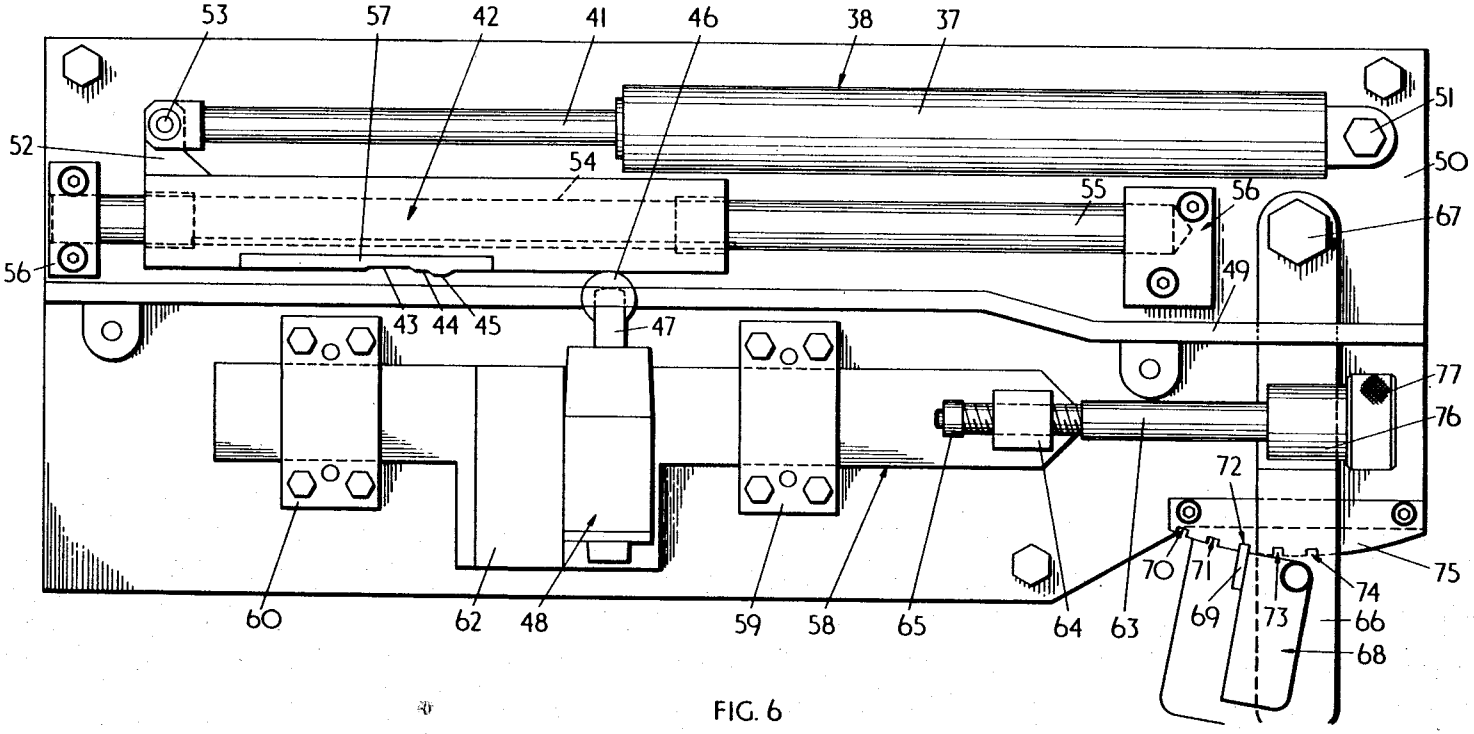

By way of example only, one embodiment of the present invention will be described with reference to the accompanying drawings, in which:

FIGS. 1 to 5 diagrammatically illustrate mining equipment in accordance with the present invention, the equipment being illustrated in various operational conditions; and FIG. 6 shows a partial side view of a detail of FIGS. 1 to 5 on an enlarged scale and in more detail.

FIGS. 1 to 5 illustrate a ranging arm 1 of a ranging drum shearer coal winning machine (only the ranging arm 1 and rotary cutter drum or head 2 of which are shown). In operation, the machine repeatedly traverses to and fro along an armoured face conveyor (not shown) extending along a longwall working face such that the rotating cutter drum wins and loads coal from the working face. The ranging arm is supported in a pivotal mounting for movement about a generally horizontal axis 3, the pivotal movement being controlled by hydraulic rams (not shown) connected between the machine body and the ranging arm. An electric drive motor (not shown) is drivably connected to gear mechanism extending along the arm to drivably engage the cutter drum which in turn is rotated about the axis 3.

The arrangement is such that as the machine traverses along the working face in one direction the ranging arm 1 is raised under the action of the ram such that the cutting drum 2 is in a raised operational condition adjacent to the mine roof (substantially as indicated in FIGS. 1 to 5). In this raised operational position the cutting drum forms two cut mineral profiles, i.e. the mine roof 10 and a lower bench profile.

When the machine next traverses along the working face in the opposite direction, the ranging arm 1 is lowered under the action of the ram such that the cutter drum is in a lowered operational position adjacent to the mine floor. In this position the cutting drum forms one cut rock or mineral profile (i.e. the mine floor) and removes the mineral left below the bench profile left on the machine's previous traverse.

Upon all the mineral being removed from the working face the machine together with the conveyor is advanced towards the newly formed working face and the whole of the above outlined mineral winning operation repeated.

The mining machine of FIGS. 1 to 5 may be provided with sensing means for detecting the cutting horizons of the cutter drum with respect to the mineral seam. These sensing means may comprise a device for detecting the thickness of roof mineral left by the machine on the immediately proceeding mine roof cutting traverse and for deriving a signal indicative of the sensed thickness. The derived signal is fed to steering control means (not shown) which control the rams to maintain the machine's cutting horizon and a desired level within the mineral seam. Such sensing means may comprise, for example, a probe for detecting natural gamma radiation emitted from the overlaying strata and attenuated by its passage through the roof layer. Alternatively, the sensing means may comprise a source and detector of radiation or of a sonic, ultra sonic signal, sonic or radar.

The mining machine also is provided with mining equipment constructed in accordance with the present invention, the equipment comprising a boom 30 which is pivotally mounted on a support housing 31 fixedly secured to the ranging arm 1 and which is urged to contact the mine roof 10 under the action of a hydraulic motor constituted by a hydraulic double acting ram 32 the piston rod 29 of which acts on boom 30 via a crank lever 33. In other embodiments the ram 32 acts directly on the boom 30.

The boom 30 is urged to contact the mine roof formed on the immediately previous roof forming traverse.

FIGS. 1 to 5 show that the annulus side of the cylinder 34 of the ram 32 is hydraulically connected to a change over flow control valve 35 via a line 36 and that the full bore side of the cylinder 34 is hydraulically connected via line 39 to the full bore side of a cylinder 37 of hydraulic sensing means constituted by a further piston and cylinder device 38. The annulus side of the device 38 is hydraulically connected to the aforementioned change over flow control valve 35 via line 40.

The piston rod 41 of the piston and cylinder device 38 is shown to be fixedly connected to an element 42 mounted for longitudinal movement relative to the device 38 and defining a stepped or cam profile 43, 44, 45 abutted by a roller 46 mounted on one end of an operating spool 47 of a further change over flow control valve 48 provided in the hydraulic actuating circuit (not shown) associated with aforementioned ram for controlling pivotal movement of the ranging arm 1 to vary the cutting horizon of the cutter drum 2. Details of the piston and cylinder device including the element 42 and the associated flow control valve 48 will be described later in this specification with reference to FIG. 6.

The operation of the mining equipment now will be described particularly with reference to FIGS. 1 to 5.

Figure 1:
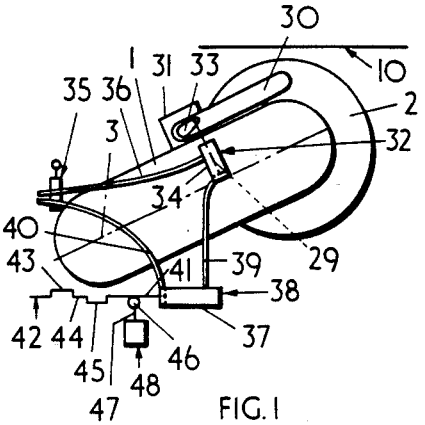

In FIG. 1 the equipment is shown in a position in which the ranging arm 1 can be raised or lowered under the manual control of a main flow control valve for the aforementioned ram. The roller 46 of the spool valve 48 is disengaged from the stepped or cam profile 43, 44, 45 and instead in engaging a portion of the element 42 in which the boom 30 is urged by the ram 32 into a 'rest' lowered position remote from the mine roof 10. Pressure fluid is fed via the change over flow control valve 35 and along line 36 to fully retract the ram 32. Fluid discharged from the full bore side of the cylinder 34 is passed along line 39 to the full bore side of the cylinder 37 of the device 38 which thereby is fully extended moving the stepped or cam profile away from the roller into the 'rest' position mentioned above.

Figure 2:
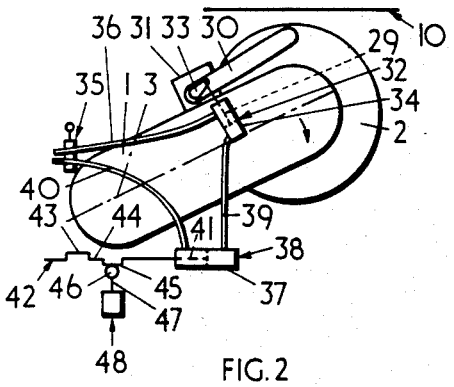

Upon the valve being manually switched to an automatic operation position pressure fluid now is fed along line 40 to the annulus side of the cylinder 37 of the device 38. Simultaneously the line 36 from the annulus side of the cylinder 34 of the ram 32 is hydraulically connected to a tank. When sufficient pressure fluid has been fed to the annulus side of the cylinder 37 the retraction of the piston rod causes the roller 46 to be brought into engagement with the stepped profile 45 (the operational position now is as indicated in FIG. 2). Upon the roller engaging the stepped profile 45 the spool 47 is urged to move to operate the control valve 48 such that pressure fluid in the circuit controlling pivotal movement of the ranging arm 1 causes the arm to begin to lower. It is desired in a typical installation that the total lowering of the ranging arm due to the roller engaging the stepped profile should not exceed about sixty millimeters.

As the piston rod 41 of the device 38 retracts, fluid discharged from the cylinder 37 is fed along line 39 into the full bore side of the cylinder 34 of the ram 32 causing its piston to act on the crank lever 33 thereby urging the boom towards a mine roof engaging position.

By the time the boom 30 contacts the mine roof 10 the piston rod 41 of the device 38 has retracted sufficiently for the roller 46 to have passed the stepped profile 45. The roller 46 now is engaging the centre profile 44 in which the cutter drum 2 is set to cut a roof profile 10 at a preselected height with respect to the mine roof profile formed by the cutter drum 2 on the immediately previous roof cutting traverse. The height of the mine roof profile formed by the cutter drum 2 on the immediately previous roof cutting traverse is sensed by the boom 30 which as previously stated is in contact with the mine roof. If the boom is not in contact with the mine roof formed on the previous traverse by the time the roller 46 has reached the intermediate profile 44 then the ranging arm 1 is raised until the boom does just contact the mine roof. The operational position now is as indicated in FIG. 3.

Upon the machine commencing its roof cutting traverse along the working face cutter drum 2 substantially is maintained at a preselected desired height relative to the immediately previously formed mine roof by the action of the mining equipment constructed in accordance with the present invention. If as the machine traverses along the working face the cutter drum should tend to cut at a lower horizon relative to the previous cut than desired then the boom which is retained in contact with the roof of the previous cut by the action of the ram 32 tends to move in a counter clockwise direction relative to the ranging arm 1 as seen in FIG. 3. Thus, the extention of the piston rod of the ram 32 tends to increase causing fluid to be drawn along line 39 from the full bore side of cylinder 37 of device 38 into the full bore side of the cylinder 34 of ram 32. This discharge of fluid from the full bore side of cylinder 37 causes the piston rod 41 to be retracted further into the piston and cylinder device 38 thereby moving the element 42 such that the roller 46 is brought into engagement with the stepped or cam profile 43 allowing the resiliently biassed spool 47 to move sufficiently so that the operational mode of the flow control valve 48 is switched and pressure fluid is fed to the aforementioned ram causing the ranging arm 1 to pivot about the axis 3 thereby raising the cutter drum. This upward movement of the ranging arm causes the piston rod of the ram 32 to be retracted further into the cylinder 34 thereby urging fluid to flow from the full bore side of the cylinder along line 39 into the full bore side of the cylinder 37 of the device 38. This feed of fluid to the device 38 causes the piston rod 41 to be further extended from the cylinder 37 and the roller 46 is once again brought into contact with the centre profile 44. Thus, the spool 47 is urged against its resilient bias sufficiently from the valve 48 to be switched to a closed operational mode and further pivotal movement of the ranging arm is prevented.

Figure 3:
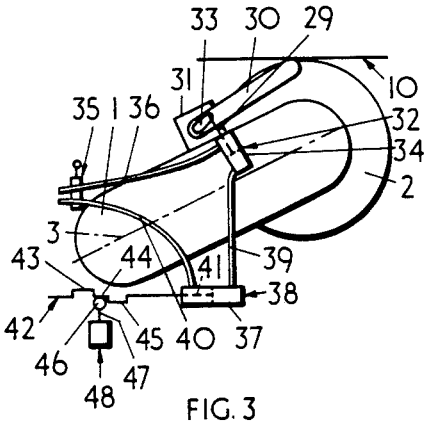
Figure 4:
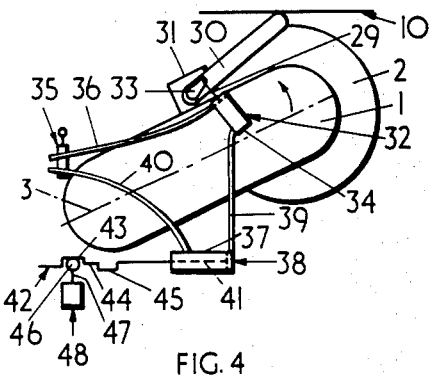

If on the other hand, the cutter drum 2 should tend to cut on a horizon higher than that desired then the boom 30 would tend to pivot in a clockwise direction relative to the ranging arm 1 as seen in FIG. 3. Such movement tends to urge the piston rod of the ram 32 to move such that fluid is discharged from the full bore side of the cylinder 34 along line 39 into the full bore side of cylinder 37. This movement of fluid tends to cause the piston rod 41 to be further extended from the cylinder 37 so that the roller 47 is brought into engagement with the stepped profile 45 on the element 42. (Into a position as indicated in FIG. 5). In this position the spool 47 is urged against its resilient bias such that the flow control valve 48 is switched into its operational mode feeding pressure fluid to the ram controlling pivotal movement of the ranging arm such that the ranging arm is lowered until the cutter drum 2 is once again cutting at the desired horizon relatively to the previous cut. This correcting movement of the ranging arm causes the piston rod of ram 32 to be extended from the cylinder 34 thereby urging fluid to be drawn along line 39 from the full bore side of cylinder 37 into the full bore side of the cylinder 34. This fluid flow causes the piston rod 41 to be retracted into the cylinder 37 sufficiently for the roller 46 to be brought into engagement with the centre profile 44 of the element 42 and for the spool 47 to move under its resilient bias such that the control valve 48 once again is switched to its closed position and further pivotal movement of the ranging arm ceases.

It will be appreciated from the above description that the mining equipment of the present invention ensures that the machine traverses along the working face the cutter drum is maintained at a preselected desired cutting horizon relatively to the immediately previously cut mine roof.

Some constructional items of the mining equipment now will be described in more detail with reference to FIG. 6 which shows the piston and cylinder device 38, the element 42 including the stepped or cam profile 43, 44, 45 and the flow control valve 48.

The items of equipment shown in FIG. 6 are mounted on a solid base plate 50 fixedly secured to the mining machine and having an upstanding rib 49 for attachment of a cover (not shown). The cylinder 37 of the piston and cylinder device 38 is connected to the base plate 50 by a bolt 51 with the end of the piston rod 41 fixedly connected to a cross bracket 52 provided on one end of the elongate element 42 by a pin 53. The elongate element 42 is provided with a longitudinally extending through bore 54 slideably engaging a slide rod 55 fixedly secured to the base plate 50 by two bolted bracket arrangements 56. Thus, the elongate element 42 is capable of longitudinal movement with the piston rod 41 upon extention and contraction of the piston and cylinder device 38. The element 42 is provided with a replaceable pad 57, an outer surface of which defines the aforementioned stepped or cam profiles 43, 44, 45.

A slide assembly 58 which is slideably mounted on the base plate 50 by two slide brackets 59, 60 carries the flow control valve 48 for controlling flow of pressure fluid to actuate the ram for raising and lowering the ranging arm.

The slide assembly 58 comprises a carrier member 62 upon which the valve 48 is fixedly secured and a screw member 63 connected to the slide member 58 via a screw block 64 pivotally mounted on the slide member. A retaining nut 65 prevents the slide and screw members being unintentionally disconnected during a setting up procedure described later in this specification. The screw member 63 is pivotally connected to a hand operated lever 66 pivotally secured to the base plate 50 by a pivot bolt 67 and capable of being retained in a selected angular position by the action of a tooth arrangement 68 pivotally mounted on the lever 66 and having a tooth 69 for selective engagement in one of a series of notches 70, 71, 72, 73, 74 provided on a notched member 75 fixedly secured to the base plate 50. In FIG. 6 the tooth is shown engaged in the notch 72. The purpose of the tooth arrangement and the pivot lever 66 will be explained later in the specification.

The screw member 63 is retained to the pivot lever 65 by a pivot block 76. A knob 77 is provided on the end of the screw member 63 enabling an operator to rotate the screw member to slidably adjust the longitudinal position of the carrier block 62. Again the purpose of the screw adjustment will be explained later in the specification.

In FIG. 6 the roller 46 on the end of the resiliently biassed spool 47 of the flow control valve 48 is shown in the rest position previously described with reference to FIG. 1, i.e. the roller 46 is disengaged from the stepped or cam profiles 43, 44, 45 and the boom (not shown in FIG. 6) is in a lowered 'rest' position away from the mine roof. As explained with reference to the previous FIGS. 1 to 5 upon pressure fluid being fed to the ram 32 the piston rod 41 is urged to extend further from the cylinder 37 of the piston and cylinder device 38 and the roller 46 is brought into engagement with the stepped or cam profiles 43, 44, 45. Thus, in operation if the cutter drum tends to cut at an horizon different to that desired with reference to the previous cut, the piston rod 41 is urged to move relatively to the cylinder 37 thereby adjusting longitudinal position of the element 42 tending to bring roller 46 into engagement with one or other of the stepped profiles 43, 45 and correcting the cutting horizon as previously explained.

The pivot lever 66 enables the operator to make adjustments to pre-set the position of the roller 46 relatively to the stepped or cam profiles 43, 44, 45 in order to initally set up the equipment enabling a desired cutting horizon to be achieved. In FIG. 6 the tooth 69 is shown engaged in the notch 72 i.e. the mid setting position. However, if it is desired to vary the cutting horizon of the present cut relative to the immediately previous cut sensed by the boom 30 the operator suitably adjusts the angular position of the pivot lever 66 by pulling on the arrangement 68 to disengage the tooth 69 from the notch 72 and pivoting the lever until the tooth 69 engages another of the notches. Typically each notch position varies the cutting horizon relative to the previous cut by 26.5 mm. Thus, the five notches enable a maximum adjustment of ±53 mm about the center position.

The screw knob 77 can be rotated by the operator to provide fine adjustment in the longitudinal position of the carrier member 62 relative to the base plate 50 and thereby the stepped profiles 43, 44, 45. This fine adjustment will be required to compensate for leakage of pressure fluid from the piston and cylinder devices 32 and 38.

From the above description it will be appreciated that the present invention provides simple, reliable and effective mining equipment for controlling the current cutting horizon of a rotary cutter drum relative to the immediately previously formed mine roof, the cutter drum being mounted on a ranging arm.

It will be appreciated that the present invention provides a relatively simple steering control equipment requiring no electric power or signals. It is foreseen that rather than provide a part of a more involved steering system as mentioned earlier in the specification the relatively simple equipment provided by this invention could be mounted on a mining machine to provide the sole or the main steering system control. In such installations the present invention provides an effective and reliable steering control.

In other embodiments of the invention the element 42 is adapted for rotary movement with the piston and cylinder device 38. A rotary stepped or cam profile would be provided to activate the flow control valve plunger 47.

We claim:

1. Mining equipment for steering the cutting horizon of a mining machine cutter which is mounted on a ranging arm and which in use, makes repeated cutting traverses, comprises a boom movably mountable with respect to the ranging arm, hydraulic motor means for urging the boom towards a rock or mineral boundary to sense a cutting horizon made by the cutter on a previous traverse, and sensor means having an element movable in accordance with the operation of the hydraulic motor means and including control means for controlling the current cutting horizon made by the cutter in accordance with the sensed operation of the hydraulic motor means, said control means comprising a flow control valve having a plunger arranged to follow a working profile provided by the element.

2. Equipment as claimed in claim 1, in which the hydraulic motor comprises a piston and cylinder device.

3. Equipment as claimed in claim 2, in which said element is movable in accordance with the operation of the piston and cylinder device constituting the hydraulic motor means, thereby movement of the piston and cylinder device controls said control means for controlling the current cutting horizon made by the cutter in accordance with the sensed operation of the piston and cylinder device constituting the hydraulic motor means.

4. Equipment as claimed in claim 3, in which the flow control valve is mounted on a support adjacent the ranging arm and means are provided for supporting the piston and cylinder device.

5. Equipment as claimed in claim 3, in which the flow control valve is mounted on a support by means permitting the position of the valve to be pre-set.

6. Equipment as claimed in claim 3, in which the piston and cylinder device constituting the hydraulic motor means acts on the boom via a crank lever.

7. Equipment as claimed in claim 2, in which the piston and cylinder device is hydraulically connected to a change over flow control valve.

8. Equipment as claimed in claim 1, in which the plunger arranged to follow the working profile is provided with a roller.

9. Equipment as claimed in claim 1, in which the flow control valve can be set in a disengaged mode in which the boom is urged by the hydraulic motor means into a position remote from the rock or mineral boundary.

* * * * *